United States Patent [19]

Rawson

[11] 4,203,189

[45] May 20, 1980

[54] METHOD AND MECHANISM FOR APPLYING THERMOPLASTIC HEELS TO SHOES

[75] Inventor: Francis F. H. Rawson, Loughborough, England

[73] Assignee: USM Corporation, Farmington, Conn.

[21] Appl. No.: 898,180

[22] Filed: Apr. 20, 1978

[30] Foreign Application Priority Data

Oct. 22, 1977 [GB] United Kingdom ..... 44052/77

[51] Int. Cl.[2] ..... B23P 11/00

[52] U.S. Cl. ..... 29/432; 29/526 R; 29/798; 264/273; 36/34 A

[58] Field of Search ..... 29/432, 526 R, 798, 29/809; 264/249, 273; 12/42 B; 227/19, 28, 29, 156; 36/34 A

[56] References Cited

U.S. PATENT DOCUMENTS

| | | | |
|---|---|---|---|
| 1,008,029 | 11/1911 | Gorman | 227/156 |
| 2,064,939 | 12/1936 | Nutt | 29/432 |
| 2,220,957 | 11/1940 | Howard | 12/42 B |
| 2,308,103 | 1/1943 | Pearson et al. | 36/34 A |
| 2,500,721 | 3/1950 | Van Dijk | 227/156 |
| 2,942,332 | 6/1960 | Wright et al. | 29/432 |

*Primary Examiner*—Lowell A. Larson

*Attorney, Agent, or Firm*—Owen J. Meegan; Richard B. Megley; Vincent A. White

[57] ABSTRACT

A fastener, for instance a wide staple having holes in its legs, is heated to a temperature above the softening temperature of the material of a heel to be attached to a shoe. The fastener is then inserted through pre-formed slots in an insole of the shoe and pressed into the heel so that heat from the fastener softens the plastic and the fastener becomes embedded in the heel to hold it attached.

5 Claims, 3 Drawing Figures

METHOD AND MECHANISM FOR APPLYING THERMOPLASTIC HEELS TO SHOES

CROSS-REFERENCE TO RELATED APPLICATION

An application for U.S. Letters Patent, Ser. No. 834,989, now U.S. Pat. No. 4,128,609, granted Dec. 5, 1978 was filed in my name on Sept. 20, 1977, relating to a method of attaching heels to shoes, the method employing ultrasonic energy.

BACKGROUND OF THE INVENTION

This invention is concerned with improvements in or relating to the manufacture of shoes and is especially concerned with methods and apparatus for attaching components such as heels to shoes.

The term "shoe" where used herein is to be understood as referring to outer footwear generally whether complete or in the course of manufacture.

It is a common practice in the shoe industry to attach heels by means of nails which are hammered through the insole of the shoe into the heel. In most cases, if four or six nails are used, adequate heel attachment can be achieved whether the heel is made of wood or of thermoplastic material. However, in some circumstances, adequate heel attachment is difficult to achieve. For example, in the case of sharply tapering heels, e.g. stiletto heels, which are generally made of thermoplastic material since wood is not sufficiently strong, it may be difficult to insert a sufficient number of nails in the limited area available. The area available is limited by the taper of the heel which reduces the area where there is sufficient depth of material for each nail to be inserted. The nailing area available may also be reduced by the presence of a shank in the shoe.

It is one of the various objects of the present invention to provide an improved method of attaching a heel which comprises thermoplastic material to a shoe, which method enables a fastener to be embedded in the thermoplastic material of the heel.

There is hereinafter described in detail an apparatus suitable for use in attaching a heel which comprises thermoplastic material to a shoe, this apparatus being illustrative of the invention in its apparatus aspects. There is also hereinafter described in detail a method of using the illustrative apparatus to attach such a heel to a shoe, this method being illustrative of the invention in its method aspects.

The illustrative apparatus comprises a gauge plate in the shape of the heel seat of a shoe which provides shoe locating means whereby a shoe can be located for a heel to be attached thereto by being fitted over the gauge plate. The illustrative apparatus also comprises clamping means whereby a heel to be attached can be clamped against the heel seat of a shoe located by the gauge plate. The clamping means comprises a pad arranged to engage the ground-engageable surface of the heel, a pad arranged to engage a rear surface of the heel, and a piston and cylinder assembly arranged to press the pads against the heel.

The illustrative apparatus also comprises heating means in the form of electric cartridge heaters which are arranged to heat a fastener having a head portion and a shank portion to a temperature above the softening temperature of the thermoplastic material of the heel. The heaters are arranged to heat the fastener while it is contained in a magazine of the illustrative apparatus. The particular fastener used with the illustrative apparatus is preferably in the form of a staple having a head and four shank portions.

The illustrative apparatus also comprises fastener locating means whereby a fastener heated by the heating means can be appropriately located for insertion through the insole of a shoe located by the gauge plate and into a heel thereof. The fastener locating means comprises a bush made of a heat-insulating material in which the heated fastener can be positioned prior to the shoe being located by means of the gauge plate. When located in the bush, a fastener rests on a pusher which is movable by insertion means of the illustrative apparatus in the form of a piston and cylinder assembly. The insertion means is operable to insert a fastener located by the bush through the insole of a shoe located by the gauge plate so that the fastener shank portion passes through the insole and into the thermoplastic material of the heel. The insertion means causes the pusher to press the fastener while heated through the insole and into the heel.

In the illustrative method of attaching a heel which comprises thermoplastic material to a shoe, the fastener to be used is heated to a temperature above the softening temperature of the thermoplastic material of the heel, the heated fastener is located for insertion using the fastener locating means, the heel is located against the heel seat of the shoe, the heel is clamped in position on the located shoe as by using the clamping means referred to, and the heated fastener is then inserted by the insertion means so that the shank portions of the fastener pass through an insole of the shoe and are pressed into the thermoplastic material of the heel, heat from the fastener causing the thermoplastic material to soften thereby allowing the shank portions to enter the material and become firmly embedded therein when the fastener and material have cooled.

SUMMARY OF THE INVENTION

The invention provides, in one of its several aspects, a method of attaching a heel which comprises thermoplastic material to a shoe, the method comprising heating a fastener having a head portion and a shank portion to a temperature above the softening temperature of the thermoplastic material of the heel, and inserting the heated fastener so that the shank portion of the fastener passes through an insole of the shoe and is pressed (while heated) into the thermoplastics material of a heel which has been positioned against the heel seat of the shoe so that heat from the fastener causes the thermoplastic material to soften allowing the shank portion to enter the material and become embedded therein.

The invention provides, in another of its several aspects, an apparatus, suitable for use in a method of attaching a heel which comprises thermoplastic material to a shoe, comprising shoe locating means whereby a shoe can be located for a heel to be attached thereto, clamping means whereby a heel to be attached can be clamped against the heel seat of a shoe located by the locating means, heating means arranged to heat a fastener having a head portion and a shank portion to a temperature above the softening temperature of the thermoplastic material of the heel, fastener locating means whereby a fastener heated by the heating means can be located for insertion through the insole of a shoe located by the shoe locating means and into a heel thereof, and insertion means operable to insert a fastener located by the fastener locating means through the insole of a shoe located by the shoe locating means so that the shank portion of the fastener passes through the insole and is pressed into the thermoplastic material of the heel.

BRIEF DESCRIPTION OF THE DRAWINGS

The above and other of the various objects and several aspects of the invention will become more clear from the following detailed description, to be read with reference to the accompanying drawings, of the illustrative apparatus and the illustrative method aforementioned. It is to be understood that the illustrative apparatus and the illustrative method have been selected for description by way of example and not of limitation of the invention.

In the accompanying drawings.

Figure 1:
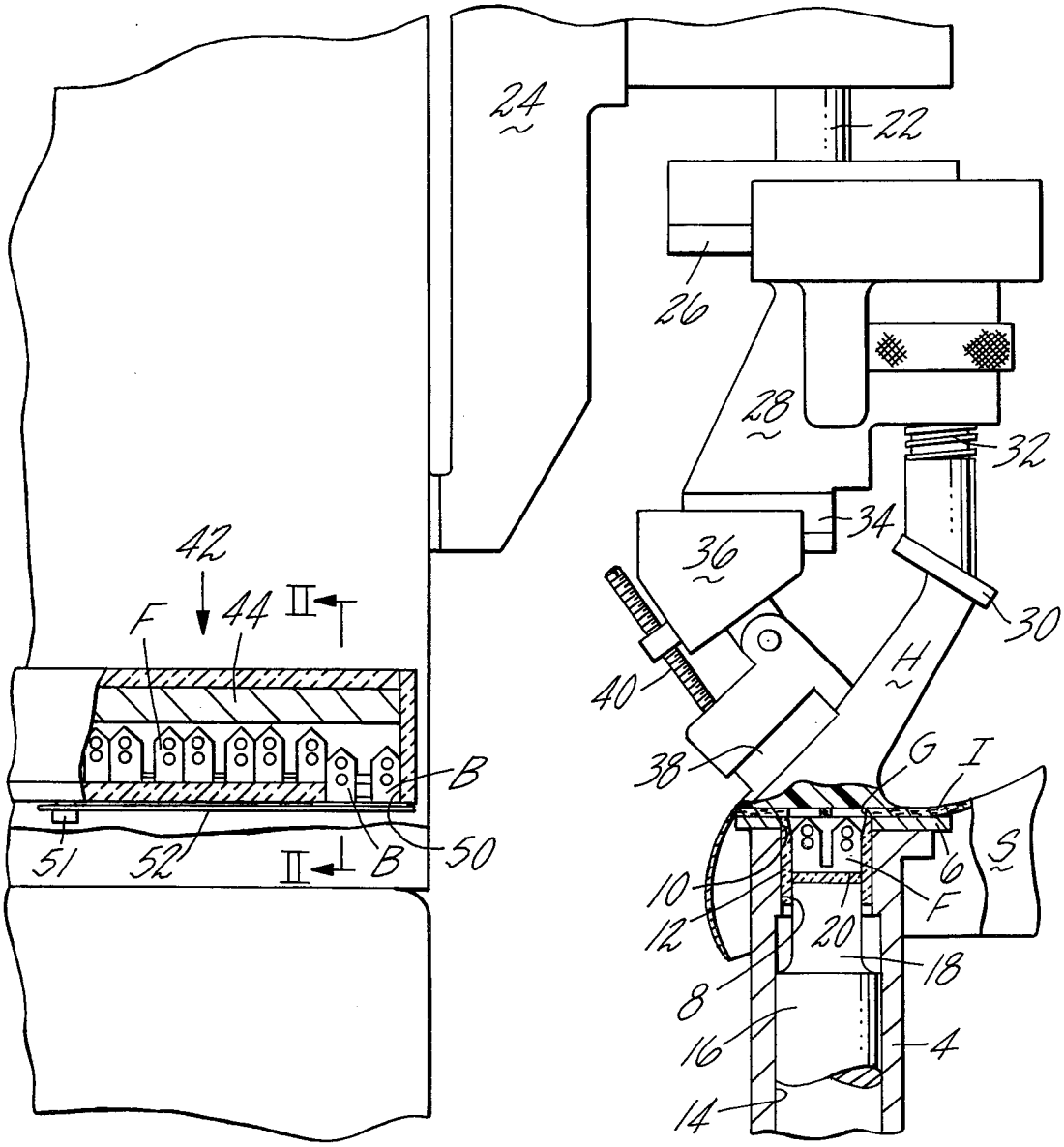
FIG. 1 is a side elevational view, partly in section, of a portion of the illustrative apparatus.
Figure 3:
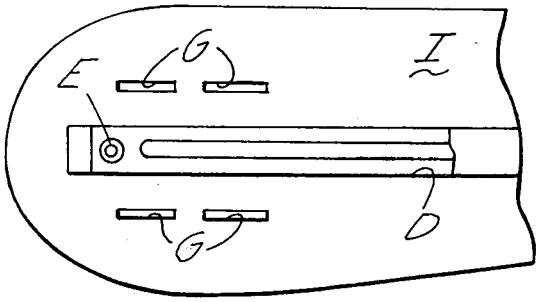
FIG. 3 is a plan view of a portion of an insole of a shoe to which a heel is to be attached using the illustrative method.

The illustrative apparatus is suitable for use in a method of attaching a heel H (FIG. 1) which comprises thermoplastic material to a shoe S which comprises an insole I (FIGS. 1,3). The illustrative apparatus comprises a vertically-extending cylindrical stand 4 (FIG. 1) on top of which a gauge plate 6 is mounted. The gauge plate 6 provides shoe locating means whereby the shoe S can be located for the heel H to be attached thereto. The gauge plate 6 has the shape (in plan view, now shown) of the heel seat of a shoe and the shoe S is located by being fitted over and around the gauge plate 6. The gauge plate 6 is readily removable and can thus be replaced by a gauge plate of appropriate different size or shape.

A rectangular (in plan view) recess 8 is formed in an upper portion of the stand 4 so that it communicates with a rectangular hole 10 extending through the gauge plate 6. A bush 12 made of a heat-insulating material is mounted in the recess 8 and extends into the hole 10. The upper surface of the bush 12 is flush with the upper surface of the gauge plate 6. The bush 12 provides fastener locating means whereby a fastener F to be used in attaching a heel H to a shoe S can be located for insertion. A fastener F is located for driving by being dropped into the bush 12 from immediately above the gauge plate 6.

Figure 2:
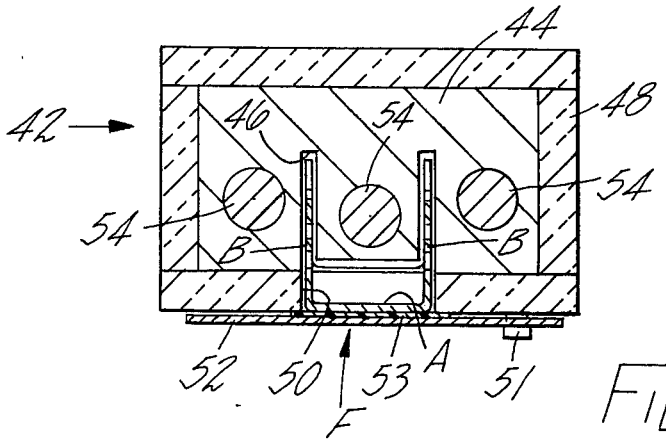
FIG. 2 is a sectional view taken on the line II—II of FIG. 1, but on a larger scale.

A fastener F may, for instance, be in the form of a steel staple having a head portion A (FIG. 2) and four shank portions B, two of which extend parallel to one another on each side of the head portion A. Each of the shank portions B is in the form of a spike or projecting leg with preferably two holes transversely extending therethrough (FIG. 1).

The stand 4 has a vertically-extending bore 14 therein which communicates with the recess 8. Movable vertically in the bore 14 is a piston 16 of a piston and cylinder assembly. The piston 16 comprises an upper portion 18 which is rectangular is plan view and extends into the bush 12 where it slidably carries a pusher 20 made of a heat-insulating material. The piston and cylinder assembly provides power means for inserting a fastener F, when heated as will be described, and located in the bush 12 so that the shank portions B of the fastener F pass through the insole located by the gauge plate 6 and are pressed into the thermoplastic material H.

The illustrative apparatus also comprises clamping means whereby the heel H to be attached to the shoe S can be clamped against the heel seat of the shoe when the shoe has been located by the gauge plate 6. The clamping means preferably comprises a piston and cylinder assembly (only the piston 22 thereof is shown in FIG. 1 ) which is mounted on a bracket 24 above the stand 4. The piston 22 carries a slideway 26 on which a support 28 is slidable longitudinally of the shoe as located by the gauge plate 6. The support 28 carries a pad 30 which is arranged to engage a ground-engageable surface of the heel H on the heel seat of the shoe. The height of the pad 30 on the support 28 can be adjusted by means of a screw 32. The support 28 also carries a slideway 34 on which a support 36 is slidable relative to the pad 30 longitudinally of the shoe S. The support 36 has a pad 38 pivotally mounted thereon and arranged to engage a rear surface of the heel H located by the gauge plate 6. A screw 40 suitably limits the pivoting of the pad 38 away from the gauge plate. The arrangement is such that, when the shoe S has been located by the gauge plate 6 and the heel H has been positioned on the heel seat portion of the shoe, operation of the piston and cylinder assembly causes the pads 30 and 38 to be lowered from an out-of-the-way position thereof until they engage the heel H and clamp it in position for attachment as shown in FIG. 1.

The illustrative apparatus also comprises feeding means for feeding the fasteners F to the bush 12. The feeding means comprises a magazine 42 (FIGS. 1 and 2) comprising a metal block 44 which has a U-shaped channel 46 (FIG. 2) therethrough in which are received a plurality of fasteners F. The channel 46 comprises a groove in the lower surface of the block which slidably receives the head portions A of the fasteners F and two parallel slots extending normally to the groove which receive the shank portions B of the fasteners. The block 44 is surrounded by heat-insulating material 48 on which the head portions A of all but the leading ones of the fasteners F rest. The fasteners are urged forwardly, i.e. towards the stand 4, in the magazine 42 by pushing means (not shown) until the forwardmost of the fasteners F falls into a hole 50 (FIGS. 1 and 2) in the material 48 where it rests on a heat-insulating pad 53 mounted on a plate 5 which is pivotally mounted on a pin 51 (see FIG. 2), projecting from the underside of the block 44. The illustrative apparatus also comprises manual or power actuated means (not shown) operable to move the magazine 42 between a position in which the hole 50 is vertically aligned with the bush 12 and a retracted position in which the magazine is shown in FIG. 1, and means for pivoting the plate 52 on the pin 51 to an out-of-the-way position so that the foremost fastener F drops into the bush 12.

Heating means is provided in the form of three electric cartridge heaters 54 (FIG. 2) embedded in the block 44, for heating the fasteners F in the magazine 42 to a temperature above the softening temperature of the thermoplastic material of the heel H to be attached.

The illustrative method of using the illustrative apparatus will now be described. With the pads 30 and 38 in a raised inoperative condition in which they are well above the gauge plate 6 and the magazine 42 in its retracted position, the magazine 42 is loaded with fasteners F and the heaters 54 are switched on to raise the temperature of the fasteners F above the softening temperature of the thermoplastic material of the heel H.

When the fasteners F in the magazine 42 have reached the required temperature, the magazine 42 is moved to a position above the stand 4 so that the foremost fastener F is aligned with the bush 12. Next, the means for pivoting the plate 52 is operated to pivot the plate 52 about the pin 51 thereby allowing the foremost fastener F to drop into the bush 12 where it rests on the pusher 20. The heated fastener has now been located for insertion. The magazine 42 is now returned to its retracted position.

After the fastener F has thus been located, the shoe S to which the heel H is to be attached is located on the stand 4 by means of the gauge plate 6. The insole I (FIG. 3) may be secured to a shank D by eyelets E. There are four slots G through the insole I in the heel seat region, two on each side of the shank D. The slots G are arranged in the same relative positions as the shank portions B of the fastener F. When the shoe S has been located as described, the slots G are above the fastener F in the bush 12, and the heel H is positioned on the heel seat, the clamping means is operated to bring the pads 30 and 38 into engagement with the heel H (the apparatus is now in the condition shown in FIG. 1).

The piston and cylinder assembly of the stand 4 is next operated so that the pusher 20 urges the heated fastener F in the bush 12 upwards initially inserting it through the insole I so that its shank portions B enter the slots G and the head portion A overlies a portion of the insole I and transversely bridges the shank D. The insertion of the fastener F brings its shank portions B into engagement with the thermoplastic material of the heel H. Further operation of the piston and cylinder assembly presses the fastener F into the thermoplastic material of the heel H so that heat from the fastener F softens the adjacent thermoplastic material allowing the shank portions B to enter the material and become embedded therein. The thermoplastic material may flow into the holes in the shank portions B so that, when the material cools and solidifies, there will be a positive lock between the fastener F and the heel H.

It is important, when carrying out the illustrative method that the fastener F is pressed into the thermoplastic material of the heel H while it is sufficiently hot to enable it to soften enough of the material to become embedded but is not so hot that it degrades the material. Where the heel H is made of polystyrene which has a softening point of approximately 98° C. the fastener F might be heated to 200° C., although the exact temperature will depend on the dimensions of the fastener F, the thermal capacity of the fastener F, and the time taken between heating the fastener F and inserting it.

I claim:

1. The method of attaching a heel formed of thermoplastic material to a shoe having an insole and a reinforceing shank, which method comprises:

heating a fastener which has a head and at least two shank portions each of which has at least one hole therethrough to a temperature above the softening point of the thermoplastic material of the heel;

positioning the heel and the shoe for attachment;

and then inserting the fastener into the material of the heel so that its shank portions extend through the insole, one on each side of the reinforcing shank of the shoe, at least a portion of the thermoplastic material being softened by heat from the fastener to allow the shank portions to enter the material and become embedded therein with thermoplastic material extending into the holes in the shank portions.

2. The method of claim 1 characterized by, for the attachment of heels in succession to a plurality of shoes perspectively, maintaining a plurality of the fasteners at said temperature in a heated movable magazine, and moving the magazine to shift endmost fasteners therein to and from alignment with a fastener inserting position to release successive endmost fasteners with their shank portion immediately adjacent a gage for locating the heel seats of the insoles and with the fastener head portion supported by a driver in readiness to be driven into said heel material.

3. Apparatus for attaching a heel formed of a thermoplastic material to a shoe having an insole, the apparatus comprising: means for relatively positioning the heel against the heel seat; a movable magazine adapted to slidably support a plurality of fasteners in a row; means for heating at least one fastener, said fastener having a head and shank portions, to a temperature above the softening temperature of the thermoplastic material of the heel, means for releasing successive heated fasteners for delivery from said magazine; means for positioning the thus heated fastener for insertion through the insole of the clamped shoe, and insertion mechanism operable to press the shank portions of the heated fastener through the insole and into the thermoplastic material of the heel.

4. Apparatus as in claim 3 wherein the means for relatively positioning the heel and heel seat of the shoe comprises a gauge plate formed with a hole and corresponding in shape to the heel seat, said means for positioning the heated fastener comprises a fastener receiving bush aligned with the hole in the gauge plate and with a movable fastener driver of said insertion mechanism.

5. Apparatus as in claim 3 wherein said insertion mechanism comprises a reciprocable driver and a tubular guide for directing the driver toward and from the heel, and said fastener releasing means comprises a pivotal member associated with the magazine to release the heated foremost fastener therein for positioning in said guide for operative alignment with said driver.

* * * * *